US008562396B1

(12) United States Patent
Piliguian

(10) Patent No.: US 8,562,396 B1
(45) Date of Patent: Oct. 22, 2013

(54) GRINDING OR POLISHING DISC WITH IMPROVED VISIBILITY AND AIR FINS FOR VORTEX COOLING OF THE WORKPIECE DURING EH GRINDING OPERATION

(76) Inventor: Raffi Piliguian, North Hollywood, CA (US)

( * ) Notice: Subject to any disclaimer, the term of this patent is extended or adjusted under 35 U.S.C. 154(b) by 140 days.

(21) Appl. No.: 13/313,981

(22) Filed: Dec. 7, 2011

(51) Int. Cl.
*B24D 99/00* (2010.01)

(52) U.S. Cl.
USPC ..... 451/548; 125/15

(58) Field of Classification Search
USPC ..... 451/548; 125/15
See application file for complete search history.

(56) References Cited

U.S. PATENT DOCUMENTS

| | | | | |
|---|---|---|---|---|
| 2,755,601 | A * | 7/1956 | Lux | 451/178 |
| 3,711,999 | A * | 1/1973 | Held | 451/541 |
| 5,040,341 | A * | 8/1991 | Okinaga | 451/541 |
| 7,377,837 | B2 | 5/2008 | Piliguian | |
| 2003/0143926 | A1 * | 7/2003 | Piliguian | 451/6 |
| 2005/0255798 | A1 * | 11/2005 | Piliguian | 451/177 |
| 2006/0040597 | A1 * | 2/2006 | Piliguian | 451/177 |

* cited by examiner

*Primary Examiner* — Maurina Rachuba
(74) *Attorney, Agent, or Firm* — Thomas I. Rozsa

(57) ABSTRACT

A grinding or polishing disc which in addition to having improved viewing areas so that the object can be appropriately and clearly viewed as it is being ground or polished, also has vertical fins which create an airflow vortex similar to a turbine that go into the viewing locations to provide a cooling airflow to the workpiece so that in addition to being able to see the workpiece, the airflow cools the workpiece as the disc is being rotated.

6 Claims, 5 Drawing Sheets

GRINDING OR POLISHING DISC WITH IMPROVED VISIBILITY AND AIR FINS FOR VORTEX COOLING OF THE WORKPIECE DURING EH GRINDING OPERATION

BACKGROUND OF THE INVENTION

1. Field of the Invention

The present invention relates to the field of grinding and polishing discs which are used in conjunction with grinding and polishing machines to grind and polish the surface of objects. The disc is used in conjunction with well-known grinding and polishing machines having a motor driven shaft which include an exhaust duct or hood for removing dust and debris.

2. Description of the Prior Art

The present inventor is the inventor of issued U.S. Pat. No. 7,377,837 issued on May 27, 2008 for "Grinding or Polishing Arrangement".

Many forms of grinding and polishing machines and devices have been utilized in the past in a wide variety of applications. In general, all such grinding or polishing machines or devices incorporate a rotating grinding or polishing disc against which a workpiece that is to be ground or polished is positioned. Some of the machines or devices are fully automated; some are hand held devices; and some utilize a manual positioning of a workpiece against the rotating grinding or polishing disc. In general, such grinding or polishing machines in which the workpiece was manually positioned against the rotating grinding or polishing disc were characterized in that they generally comprised a housing in which an electrically powered motor was installed. The motor rotated a vertically oriented shaft and on the remote end of the output shaft there was mounted the grinding or polishing disc. The workpiece to be ground or polished was generally placed against the under side of the disc and the grinding or polishing was commenced on the surface of the workpiece. As the grinding or polishing continued, dust or particulate matter was generated by the abrasion of the grinding or polishing disc on the workpiece. A hood or duct was placed in close relationship to the workpiece and the hood or duct had an opening into which the dust or particulate matter was conducted to be removed to regions spaced from the grinding or polishing machine. In many applications, a vacuum generating pump or device was connected to the remote end of the duct to aid in the removal of the dust or particulate matter.

Such devices had several disadvantages. Since the workpiece was located under the rotating disc to be placed against the underside thereof, the view of the workpiece was often obstructed by the disc. Some prior art discs had a few, narrow radial apertures in regions adjacent the outer periphery of the disc and a small portion of the workpiece was visible therethrough during the grinding or polishing operation. However, very often the workpiece was removed from engagement with the disc at various times in order to inspect the condition of the workpiece and then the workpiece was replaced in the grinding or polishing relationship to the underside of the grinding or polishing disc. Further, the exhaust duct or hood was often not located in the position with respect to the workpiece to allow efficient removal of the dust or particulate matter.

Accordingly, there has long been a need for a grinding or polishing disc in which more of the surface of the workpiece that is being ground or polished may be visible and in which a larger portion of the dust or particulate matter generated during the grinding or polishing operation may be removed.

The previous invention of the present inventor identified and claimed in U.S. Pat. No. 7,377,837 addressed the issue of improving the visibility of the workpiece. However, the workpiece still became very hot and hard to handle. Therefore, in addition to improving the visibility of the workpiece, there is a significant need to provide a cooling vortex to enable the workpiece to be appropriately cooled in addition to being cooled while it is ground and polished.

SUMMARY OF THE INVENTION

The present invention is an improved grinding or polishing disc which in addition to having improved viewing areas so that the object can be appropriately and clearly viewed as it is being ground or polished, also has vertical fins which create an airflow vortex similar to a turbine that go into the viewing locations to provide a cooling airflow to the workpiece so that in addition to being able to see the workpiece, the airflow cools the workpiece as the disc is being rotated.

It is has been discovered according to the present invention that by incorporating a multiplicity of axial rotatable fins which are orientated at an angle which extend from a high point at the peripheral edge of the disc to an area where they are virtually in line with the surface of the disc at the location where airflow begins to accumulate, then the airflow which moves at a radially outward direction is forced into the openings of the slots in the disc so that the airflow flows down into the workpiece and therefore causes cooling air to cool the workpiece in addition to providing an improved viewing of the workpiece as the disc is being rotated.

When used in conjunction with a conventional prior art grinding machine, the present invention grinding or polishing disc is coupled to the remote end of the shaft and rotates therewith. According to the present invention, the grinding or polishing disc has a plurality of cuts or slots having a predetermined pattern and extending therethrough from the upper surface thereof to the lower surface thereof. The predetermined pattern is selected to allow greater visibility of the workpiece through the disc during the grinding or polishing operation than has heretofore been available with prior art grinding or polishing discs and still have the disc with sufficient structural integrity to withstand the intended grinding or polishing operation. That is, since there are a very large variety of materials from which the workpiece may be fabricated, a workpiece that does not require great force to be used in keeping the workpiece in contact with the underside of the disc during the grinding or polishing operation, the cuts or slots may be more extensive than for a workpiece that requires a comparatively great force to hold it against the grinding or polishing disc.

The grinding or polishing disc has a generally circular peripheral edge with an upper surface having a multiplicity of raised fins with arcuate fins radiating from the external circumference up toward the center of the disc where a raised platform is created adjacent the central hub which is attached to the shaft of a rotating motor. The grinding and polishing disc has openings which are both generally perpendicular to the circumference and extend in a straight line toward the center of the disc and also have arcuate slots which extend at an arc from the circumference toward the center of the disc but most importantly, the slots are separated by raised fins which create an air vortex similar to a turbine to cause air to rotate into the location of the slots and cool the workpiece while it is being ground. This is a significant improvement over the inventor's prior invention wherein all of the discs were essentially flat or may have had a tapered surface but none of which had the fins and the vortex to create the cooling air which cools the workpiece as it flows.

The bottom surface of the grinding or polishing disc is generally planar and extends to the peripheral edge of the disc. In the preferred embodiment of the present invention, the peripheral edge has a predetermined axial thickness so that there is structure and support for the grinding or polishing operation throughout the radial extent of the grinding or polishing disc. The grinding or polishing disc may be fabricated from a unitary grinding or polishing material or the grinding or polishing disc may be a laminate. In the embodiments of the present invention wherein there is a laminate disc, there may be provided a substrate or base member of metal or other rigid material and on the bottom surface thereof is the grinding or polishing material.

In the most preferred embodiment, the present invention is molded out of a single piece of resin or other hard plastic material which can withstand the rigors of grinding and polishing while being rotated at a very high speed. The grinding or polishing disc of the present invention may be mounted on a handheld grinding or polishing device, or on an automated grinding or polishing machine which is the preferred utilization of the present invention.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
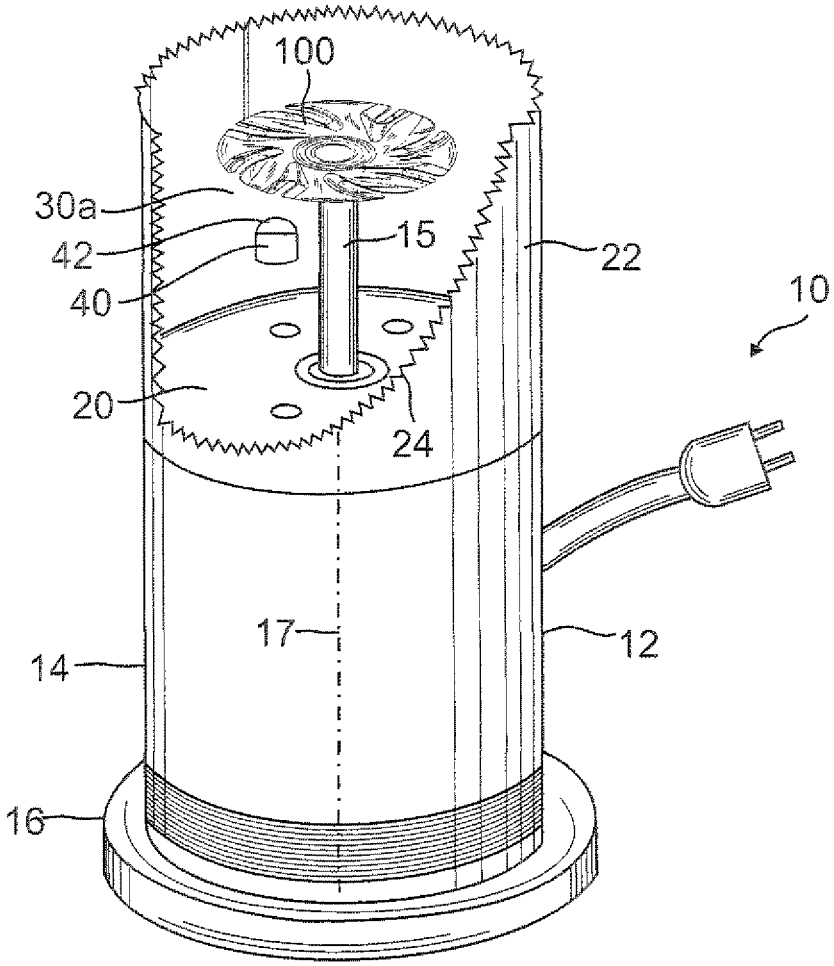
FIG. 1 is an illustration of a prior art grinding or polishing machine which utilizes the present invention improved grinding or polishing disc.
Figure 2:
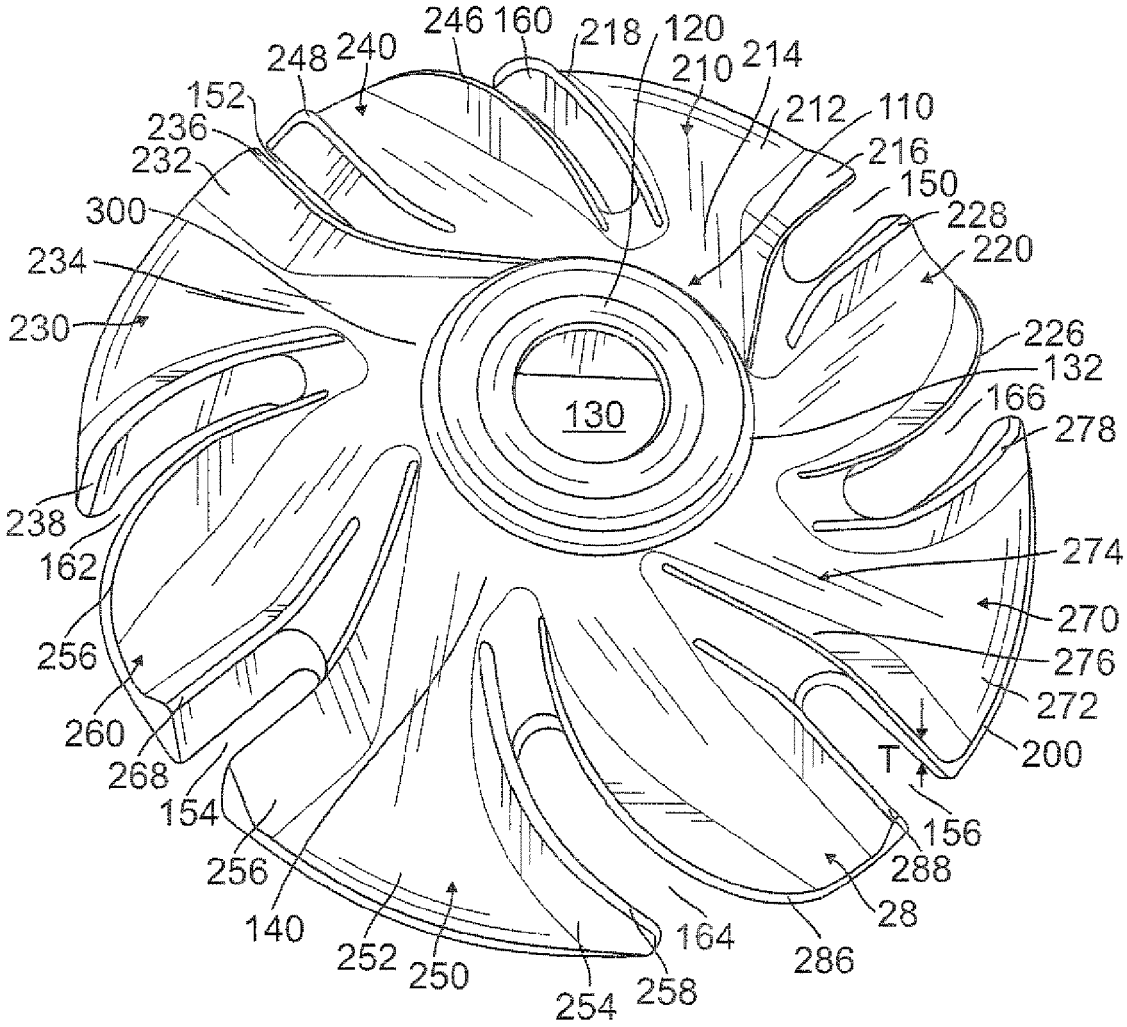
FIG. 2 is a top plan view of the present invention grinding or polishing disc.
Figure 3:
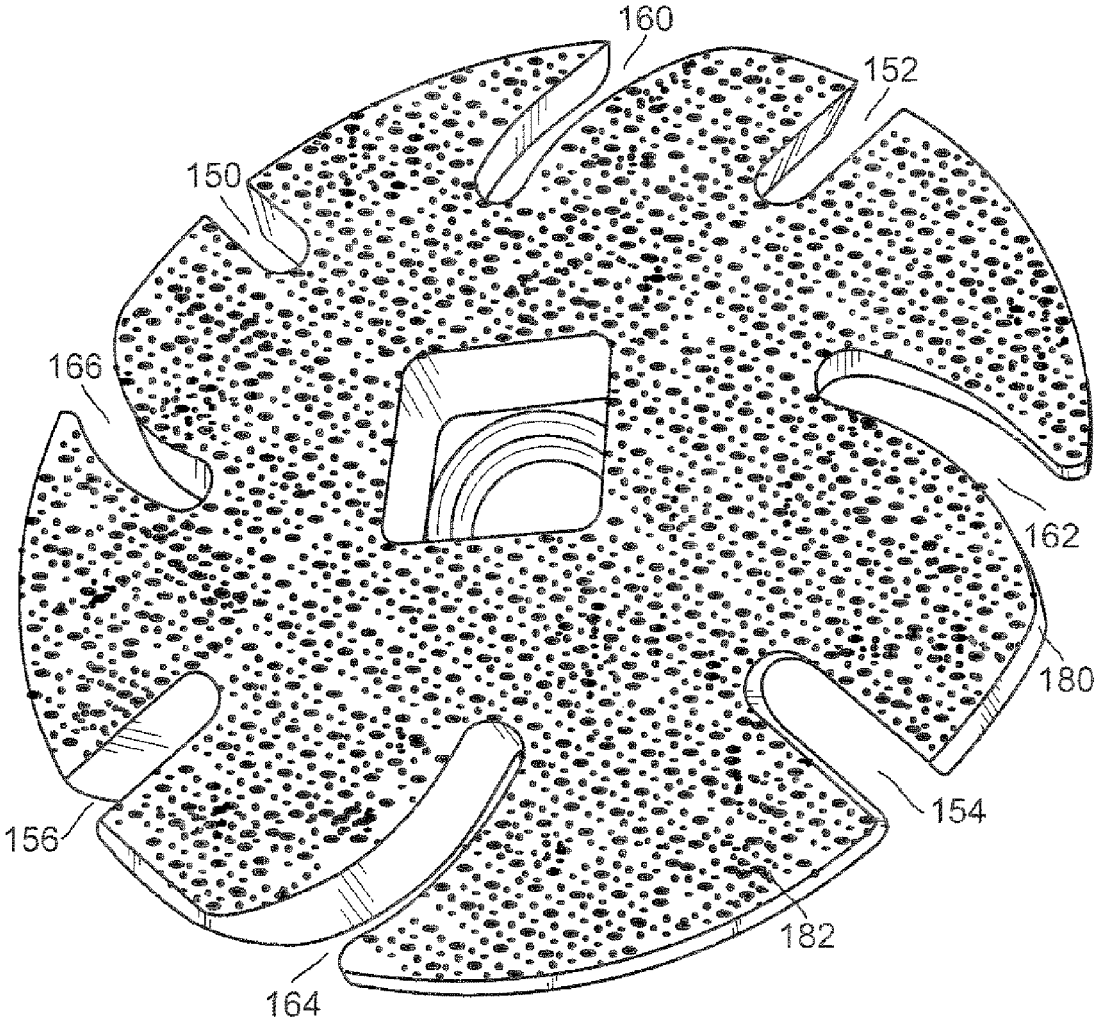
FIG. 3 is a bottom perspective view of the present invention grinding or polishing disc with sandpaper on the bottom surface.
Figure 4:
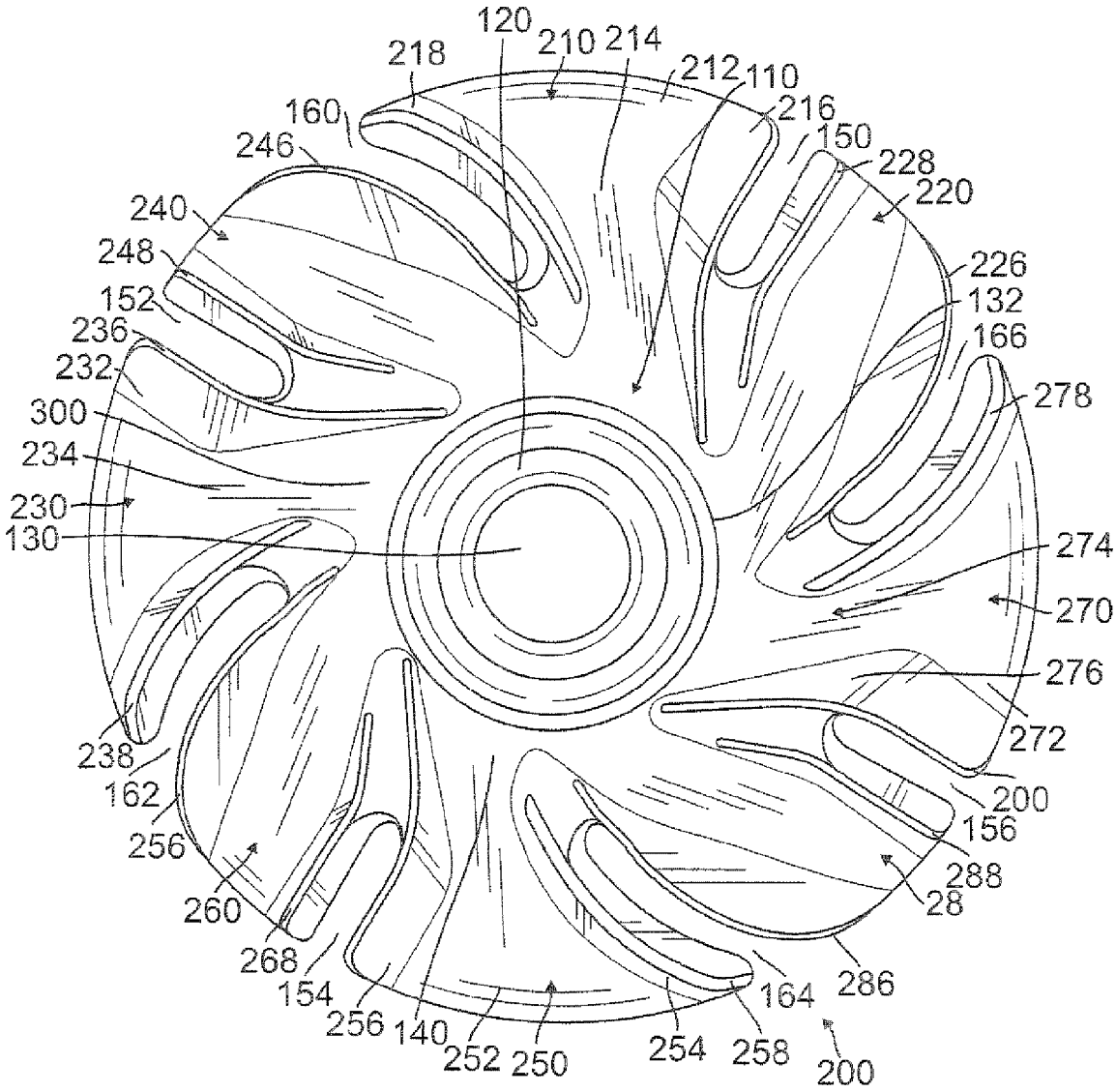
FIG. 4 is a top perspective view of the present invention grinding or polishing disc.

Referring now to the drawings, a prior art embodiment of a grinding machine is illustrated in FIG. 1. The present invention disc 100 is used with the prior art grinding machine 10 for which a workpiece is held against the bottom surface of the rotating grinding or polishing disc 100 of the present invention and the grinding or polishing machine is stationary during the grinding and polishing operation.

The grinding or polishing machine 10 of the prior art embodiment has a housing 14 with a sidewall 12 and a base 16 which supports the embodiment of the machine 10 in a generally upright and vertical position. The generally upright position provides a vertical shaft 15 upon which the grinding or polishing disc 100 is mounted for rotation therewith about axis 17 which is aligned vertically and that is perpendicular to the base 16 as illustrated in FIG. 1. The housing 14 defines a cavity therein and contains in the cavity an electrically powered motor (not shown) of conventional design for rotating the shaft 16 and grinding or polishing disc of the present invention 100. If desired, a gear box (not shown) may also be contained in the cavity defined by the housing 14 to increase or decrease the rotational speed of the motor and consequently the rotational speed of the grinding or polishing disc 100. The gear box may also be of conventional design. The motor may be a constant speed or a variable speed motor as desired for particular applications. The shaft 15 passes through a top seal plate 20 that is coupled to the housing 14 and is provided to prevent the entry of dust or particulate matter into the interior of the housing 14.

Referring to FIGS. 2 through 5, there is shown the grinding or polishing disc of the present invention. The grinding disc of the present invention has two beneficial effects, one of which previously existed in the inventor's prior invention protected in U.S. Pat. No. 7,377,837 which included improved viewing of the workpiece as the disc is grinding and the new features of having the raised fins to create an air vortex of an airflow that goes into the slots to cool the workpiece as it is being ground. The disc 100 has a peripheral edge 200 that is generally circular in shape. The disc 100 also has an upper surface 110 and a lower surface 180. The lower surface 180 is the surface which performs the grinding or polishing operation when a workpiece as indicated at 40 (see FIG. 1) is pressed against a grinding material 182 affixed to the lower surface 180 of the disc 100 so that the upper surface 42 of the workpiece 40 may be ground or polished as desired. The grinding material 182 may be sandpaper or other abrasive material affixed to the lower surface 180 of the disc 100 and is cut to match the shape of the lower surface 180.

The upper surface 110 of disc 100 has a generally flat or planar portion 120 which surrounds a central aperture 130 through which the disc 100 is coupled to the shaft of the grinding machine for rotation therewith. Initially, the upper portion of the disc has a vertical lip 132 which then transfers to a tapered section 140 which extends to approximately ⅕ the radius of the disc between the central vertical lip 132 and the exterior circumference 200. An examination of the circumference of the disc 200 shows that it has a given thickness "T" which provides structural integrity to the disc 100 to withstand the forces involved with grinding and polishing.

In order to allow greater viewing of the workpiece 40 during the grinding or polishing operation, there are provided a plurality of apertures in the disc 100 extending from the upper surface 110 to the lower surface 180. This will include 4 radial open slots 150, 152, 154 and 156 which extend from the exterior circumference 200 to approximately 40% of the radius of the disc. In addition to the straight slots and separating each of the straight slots are four generally arcuate open slots 160, 162, 164 and 166 which again extend from the exterior circumference 200 and extend in a radial arc of approximately 70 degrees and extend inwardly to a depth deeper than the straight slots so that the radial slots extend to approximately 50% of the radial length of the disc. The difference between this disc and the disc of the previous invention of the inventor identified and claimed in U.S. Pat. No. 7,377,837 is that instead of having a disc with a generally flat surface, the disc 100 extends to an entirely tapered design so that the taper goes from the vertical lip 132 to the exterior circumference 200 tapering at an even angle of approximately 45 degrees.

However, a key feature is that on the exterior surface of each disc section between the slots there are raising blades with elevated fins on exterior radial edges of the blades respectively adjacent a respective open slot. There are four wide spaced apart blades 210, 230, 250 and 270, each having a generally flat section 212, 232, 252 and 272, with each respective generally flat blade section ascending to a sloped section 214, 234, 254 an 274 which blend into the upper tapered section 300 which extends from the ascending sections to the transverse lip 132. Each wide spaced apart blade has a pair of ascending fins on opposite radial edges of the wide blade.

First wide blade 210 has a first long fin 216 which extends from the circumference 200 over the upper tapered section 300 to a location adjacent the transverse lip 132. The first long fin 216 is adjacent a straight radial open slot 150. On the opposite radial side of the first wide blade 210 is a second short fin 218 which extends from the circumference 200 to a location just beyond the innermost termination point of an adjacent arcuate open slot 160.

The second short fin ends at the location where the upper tapered section 300 begins its upwardly tapered ascent toward the transverse lip 132. There are four equally spaced apart width-wise blades 210, 230, 250 and 270 spaced approximately ninety (90) degrees apart.

Second wide blade 230 has a first long fin 236 which extends from the circumference 200 over the upper tapered section 300 to a location adjacent the transverse lip 132. The first long fin is adjacent a straight open slot 152. On the opposite radial side of the second wide blade 230 is a second short fin 238 which extends from the circumference 200 to a location just beyond the termination point of an adjacent arcuate open slot 162. The second short fin 238 ends at the location where the upper tapered section 300 begins its upwardly tapered ascent toward the transverse lip 132.

Third wide blade 250 has a first long fin 256 which extends from the circumference 200 over the upper tapered section 300 to a location adjacent the transverse lip 132. The first long fin 256 is adjacent a straight open slot 154. On the opposite radial side of the third wide blade 250 is a second short fin 258 which extends from the circumference 200 to a location just beyond the innermost termination point of an adjacent arcuate open slot 164. The second short fin ends at the location where the upper tapered section 300 begins its upwardly tapered ascent toward the transverse lip 132.

Fourth wide blade 270 has a first long fin 276 which extends from the circumference 200 over the upper tapered section 300 to a location adjacent the transverse lip 132. The first long fin 276 is adjacent a straight open slot 156. On the opposite radial side of fourth wide blade 270 is a second short fin 278 which extends from the circumference 200 to a location just beyond the inward termination point of an adjacent arcuate open slot 166. The second short fin 278 ends at the location where the upper tapered section 300 begins its upwardly tapered ascent toward the transverse lip 132.

There are four narrow spaced apart blades 220, 240, 260 and 280, each having a generally flat section 222, 242, 262 and 282, with each respective generally flat blade section ascending to a sloped section 224, 244, 264 an 284 which blend into the upper tapered section 300 which extends from the ascending section to the transverse lip 132. Each narrow spaced apart blade has a pair of ascending fins on opposite radial edges of the narrow blade.

First narrow blade 220 has a first long fin 226 which extends from the circumference 200 over the upper tapered section 300 to a location adjacent the transverse lip 132. The first long fin 226 is adjacent a arcuate radial open slot 166. and extends just beyond the innermost termination point of the adjacent arcuate open slot 166. On the opposite radial side of the first narrow blade 220 is a second short fin 228 adjacent straight open slot 150 and which extends from the circumference 200 to a location just beyond the innermost termination point of the adjacent straight open slot 150.

Second narrow blade 240 has a first long fin 246 which extends from the circumference 200 over the upper tapered section 300 to a location adjacent the transverse lip 132. The first long fin 246 is adjacent an arcuate radial open slot 160 and extends just beyond the innermost termination point of the adjacent arcuate open slot 160. On the opposite radial side of the second narrow blade 240 is a second short fin 248 adjacent straight open slot 152 and which extends from the circumference 200 to a location just beyond the innermost termination point of the adjacent straight open slot 152.

Third narrow blade 260 has a first long fin 266 which extends from the circumference 200 over the upper tapered section 300 to a location adjacent the transverse lip 132. The first long fin 266 is adjacent a arcuate radial open slot 162 and extends just beyond the innermost termination point of the adjacent arcuate open slot 162. On the opposite radial side of the third narrow blade 260 is a second short fin 268 adjacent straight open slot 154 and which extends from the circumference 200 to a location just beyond the innermost termination point of the adjacent straight open slot 154, Fourth narrow blade 280 has a first long fin 286 which extends from the circumference 200 over the upper tapered section 300 to a location adjacent the transverse lip 132. The first long fin 286 is adjacent an arcuate radial open slot 164 and extends just beyond the innermost termination point of the adjacent arcuate open slot 164. On the opposite radial side of the second narrow blade 280 is a second short fin 288 adjacent straight open slot 156 and which extends from the circumference 200 to a location just beyond the innermost termination point of the adjacent straight open slot 156.

Therefore, the present invention comprises a multiplicity of wide blades which are spaced apart by approximately ninety degrees and a multiplicity of narrow blades which are spaced apart by ninety degrees, the grinding disc having alternating wide blades and narrow blades, with four spaced apart straight open slot and four spaced apart arcuate open slots, each straight open slot between a short fin of a narrow blade and a long fin of a wide blade and each arcuate open slot between a short fin of a wide blade and a long fin of a narrow blade.

Figure 5:
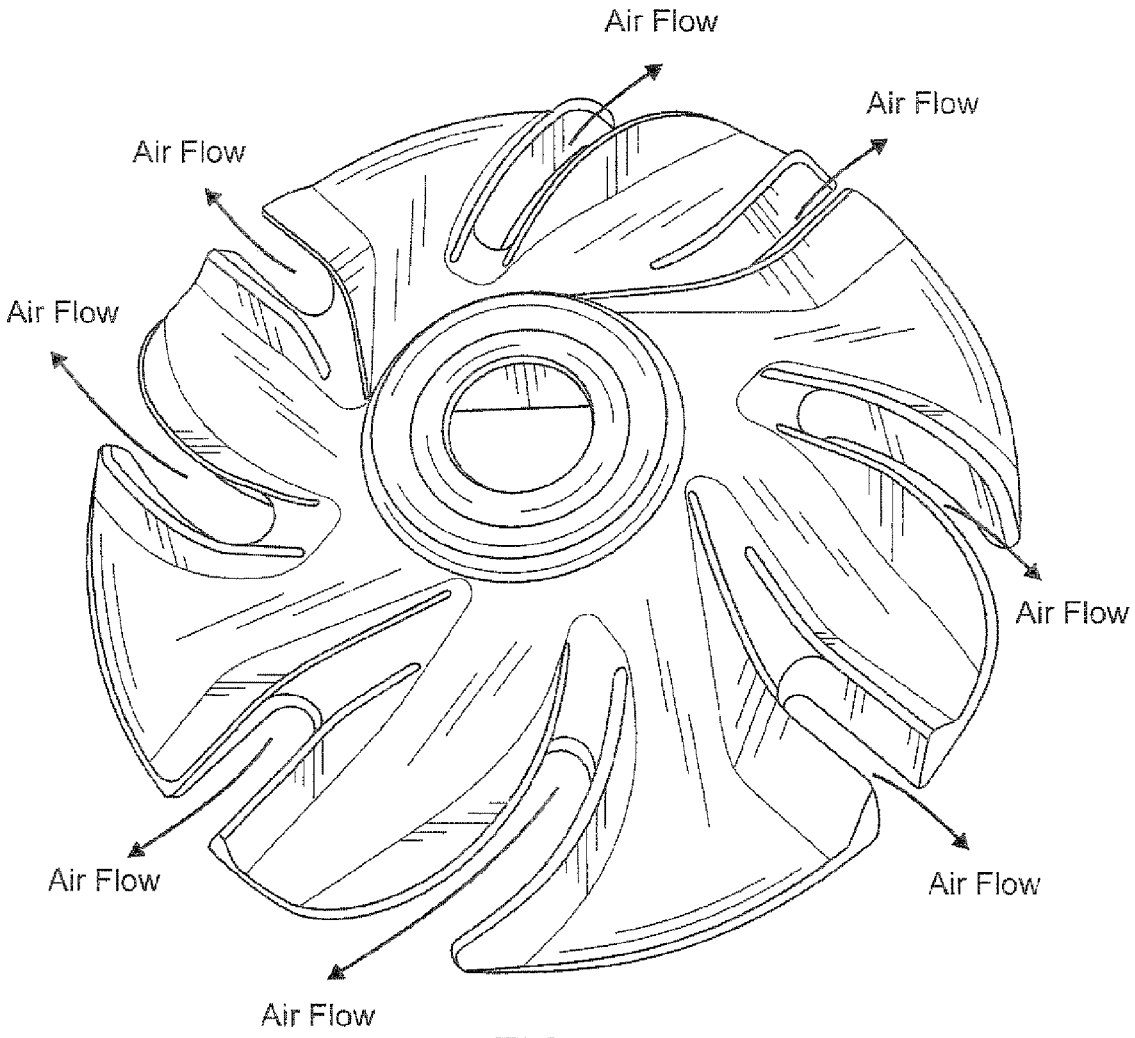
FIG. 5 is a top perspective view of a rotating present invention grinding or polishing disc illustrating the airflow through the straight and arcuate slots.

The airflow as illustrated in FIG. 5 starts at the central hub 130 and extends along flat platform 120 and over transverse lip 132 and due to the orientation of the long fins and narrow fins adjacent respective straight open slots and arcuate open slots, the air is forced into the straight open slots 150, 152, 164 and 156 and arcuate open slots 160, 162, 164 and 166 so that cooling air is transmitted to the workpiece 40 adjacent the underside 180 and sandpaper 182 of the disc 100. The wide blades with flat exterior surfaces and upwardly tapering interior surfaces and the narrow blades with flat exterior surfaces and upwardly taping interior surfaces create a turbine-like vortex which forces the cooling air out of the open slots and prevents the cooling air from flowing over the narrow blades and wide blades where it will have no cooling effect.

With the improvement of the present invention having a multiplicity of raised fins located between the straight and arcuate slots, an air vortex is created wherein air is forced by the raised fins into the straight and arcuate slots to provide cooling air to the workpiece to cause the workpiece to be much cooler as it is being ground. This is in addition to the improved viewing afforded by the straight and arcuate slots in the disc.

Therefore, based on the present invention, in addition to having the viewing substantially improved, the disc also provides for improved cooling of the workpiece.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An improved grinding or polishing disc of the type adapted to have a grinding or polishing material on a lower surface thereof comprising:

a. said grinding or polishing disc having an upper surface, a lower surface, and a center area, a central aperture in the center area extending from the upper surface to the lower surface, the central aperture enabling the disc to be coupled to a rotatable shaft for rotation therewith, the central aperture extending to a flat platform which in turn extends to a transverse lip;

b. said grinding or polishing disc having a generally circular peripheral edge, the lower surface adapted to grind or polish the surface of a workpiece, and having walls defining a multiplicity of slots extending through said grinding or polishing disc from said upper surface to said lower surface, the multiplicity of slots comprising four radially extending slots placed approximately ninety degrees apart and extending from the generally circular edge toward the center of the disc but not extending to the central aperture and four generally arcuate extending slots spaced approximately ninety degrees apart and extending from the generally circular edge toward the center of the disc but not extending to the central aperture, the radially extending slots and the arcuate slots respectively positioned so that an arcuate slot is intermediate between two radially extending slots and a radially extending slot is intermediate between two arcuate slots;

c. four wide spaced apart blades each having a generally flat section, with each respective generally flat blade section ascending to a sloped section which blend into an upper tapered section which extends from the ascending sections to the transverse lip, each wide spaced apart blade has s a pair of ascending fins on opposite radial edges of the wide blade;

d. a first wide blade having a first long fin which extends from the circumference over the upper tapered section to a location adjacent the transverse lip, the first long fin is adjacent a first straight radial open slot, on the opposite radial side of the first wide blade is a second short fin which extends from the circumference to a location just beyond an innermost termination point of an adjacent first arcuate open slot;

e. a second wide blade having a first long fin which extends from the circumference over the upper tapered section to a location adjacent the transverse lip, the first long fin is adjacent a second straight open slot, on the opposite radial side of the second wide blade is a second short fin which extends from the circumference to a location just beyond the termination point of an second adjacent arcuate open slot, the second short fin ends at the location where the upper tapered section begins its upwardly tapered ascent toward the transverse lip;

f. a third wide blade having a first long fin which extends from the circumference over the upper tapered section to a location adjacent the transverse lip, the first long fin is adjacent a third straight open slot, on the opposite radial side of the third wide blade is a second short fin which extends from the circumference to a location just beyond the innermost termination point of an adjacent third arcuate open slot, the second short fin ends at the location where the upper tapered section begins its upwardly tapered ascent toward the transverse lip;

g. a fourth wide blade having a first long fin which extends from the circumference over the upper tapered section to a location adjacent the transverse lip, the first long fin is adjacent a fourth straight open slot, a the opposite radial side of fourth wide blade is a second short fin which extends from the circumference to a location just beyond the inward termination point of an adjacent fourth arcuate open slot, the second short fin ends at the location where the upper tapered section begins its upwardly tapered ascent toward the transverse lip;

g. there are four narrow spaced apart blades each having a generally flat section with each respective generally flat blade section ascending to a sloped section which blend into the upper tapered section which extends from the ascending section to the transverse lip, each narrow spaced apart blade has s a pair of ascending fins on opposite radial edges of the narrow blade;

h. a first narrow blade has a first long fin which extends from the circumference over the upper tapered section to a location adjacent the transverse lip, the first long fin is adjacent a first arcuate radial open slot and extends just beyond the innermost termination point of the adjacent arcuate open slot, on the opposite radial side of the first narrow blade is a second short fin adjacent second straight open slot and which extends from the circumference to a location just beyond the innermost termination point of the adjacent straight open slot;

i. a second narrow blade having a first long fin which extends from the circumference over the upper tapered section to a location adjacent the transverse lip, the first long fin is adjacent a second arcuate radial open slot and extends just beyond the innermost termination point of the adjacent arcuate open slot, on the opposite radial side of the second narrow blade is a second short fin adjacent a third straight open slot and which extends from the circumference to a location just beyond the innermost termination point of the adjacent straight open slot;

j. a third narrow blade having a first long fin which extends from the circumference over the upper tapered section to a location adjacent the transverse lip, the first long fin is adjacent a third arcuate radial open slot and extends just beyond the innermost termination point of the adjacent arcuate open slot on the opposite radial side of the third narrow blade is a second short fin adjacent a fourth straight open slot and which extends from the circumference to a location just beyond the innermost termination point of the adjacent straight open slot;

k. a fourth narrow blade having a first long fin which extends from the circumference over the upper tapered section to a location adjacent the transverse lip, the first long fin is adjacent a fourth arcuate radial open slot and extends just beyond the innermost termination point of the adjacent arcuate open slot, on the opposite radial side of the second narrow blade is a second short fin adjacent a first straight open slot and which extends from the circumference to a location just beyond the innermost termination point of the adjacent straight open slot;

l. the multiplicity of wide blades which are spaced apart by approximately ninety degrees and the multiplicity of narrow blades which are spaced apart by ninety degrees, the grinding disc having alternating wide blades and narrow blades, with four spaced apart straight open slots and four spaced apart arcuate open slots, each straight open slot between a short fin of a narrow blade and a long fin of a wide blade and each arcuate open slot between a short fin of a wide blade and a long fin of a narrow blade;

m. as the disc is rotating, airflow starts at the central hub and extends along the flat platform and over transverse lips and due to the orientation of the long fins and narrow fins adjacent respective straight open slots and arcuate open slots, the air is forced into the straight open slots and arcuate open slots so that cooling air is transmitted to a workpiece adjacent the underside of the disc.

2. The grinding or polishing disc in accordance with claim 1 wherein the peripheral edge of the disc has a predetermined axial extent so that there is sufficient structural integrity of the disc at the peripheral edge to withstand the forces involved in the grinding or polishing operation.

3. An improved grinding or polishing disc of the type adapted to have a grinding or polishing material on a lower surface thereof comprising:

a. said grinding or polishing disc having an upper surface, a lower surface, and a center area, a central aperture in the center area extending from the upper surface to the lower surface, the central aperture enabling the disc to be coupled to a rotatable shaft for rotation therewith, the central aperture extending to a surface which terminates in a transverse lip;

b. said grinding or polishing disc having a generally circular peripheral edge, the lower surface adapted to grind or polish the surface of a workpiece, and having walls defining a multiplicity of slots extending through said grinding or polishing disc from said upper surface to said lower surface, the multiplicity of slots comprising a multiplicity of spaced apart radially extending slots and extending from the generally circular edge toward the center of the disc but not extending to the central aperture and a multiplicity of spaced apart generally arcuate extending slots and extending from the generally circular edge toward the center of the disc but not extending to the central aperture, the radially extending slots and the arcuate slots respectively positioned so that an arcuate slot is intermediate between two radially extending slots and a radially extending slot is intermediate between two arcuate slots;

c. a multiplicity of wide spaced apart blades each having a generally flat section, with each respective generally flat blade section ascending to a sloped section which blend into an upper tapered section which extends from the ascending sections to the transverse lip, each wide spaced apart blade has a pair of ascending fins on opposite radial edges of the wide blade, with a first long fin adjacent a straight radial open slot and a second short fin adjacent an arcuate open slot;

d. a multiplicity of narrow spaced apart fins each having a generally flat section with each respective generally flat blade section ascending to a sloped section which blend into the upper tapered section which extends from the ascending section to the transverse lip, each narrow spaced apart blade has a pair of ascending fins on opposite radial edges of the narrow blade; with a first long fin which extends from the circumference over the upper tapered section to a location adjacent the transverse lips adjacent an arcuate radial open slot, on the opposite radial side of the first narrow blade is a second short fin adjacent a straight open slot;

e. the grinding disc having alternating wide blades and narrow blades, with spaced apart straight open slots and spaced apart arcuate open slots, each straight open slot between a short fin of a narrow blade and a long fin of a wide blade and each arcuate open slot between a short fin of a wide blade and a long fin of a narrow blade;

f. as the disc is rotating, airflow starts at the central hub and extends over transverse lip and due to the orientation of the long fins and narrow fins adjacent respective straight open slots and arcuate open slots, the air is forced into the straight open slots and arcuate open slots so that cooling air is transmitted to a workpiece adjacent the underside of the disc.

4. The grinding or polishing disc in accordance with claim 3 wherein the peripheral edge of the disc has a predetermined axial extent so that there is sufficient structural integrity of the disc at the peripheral edge to withstand the forces involved in the grinding or polishing operation.

5. An improved grinding or polishing disc of the type adapted to have a grinding or polishing material on a lower surface thereof comprising:

a. said grinding or polishing disc having an upper surface, a lower surface, and a center area, a central aperture in the center area extending from the upper surface to the lower surface, the central aperture enabling the disc to be coupled to a rotatable shaft for rotation therewith, the central aperture extending to a surface which terminates in a transverse lip;

b. said grinding or polishing disc having a generally circular peripheral edge, the lower surface adapted to grind or polish the surface of a workpiece, and having walls defining a multiplicity of slots extending through said grinding or polishing disc from said upper surface to said lower surface, the multiplicity of slots comprising a multiplicity of spaced apart radially extending slots and extending from the generally circular edge toward the center of the disc and a multiplicity of spaced apart generally arcuate extending slots and extending from the generally circular edge toward the center of the disc, the radially extending slots and the arcuate slots respectively positioned so that an arcuate slot is intermediate between two radially extending slots and a radially extending slot is intermediate between two arcuate slots;

c. a multiplicity of wide spaced apart blades having a pair of ascending fins on opposite radial edges of the wide blade, with a first long fin adjacent a straight radial open slot and a second short fin adjacent an arcuate open slot;

d. a multiplicity of narrow spaced apart fins, each narrow spaced apart blade a pair of ascending fins on opposite radial edges of the narrow blade; with a first long fin which extends from the circumference adjacent an arcuate radial open slot, on the opposite radial side of the first narrow blade is a second short fin adjacent a straight open slot;

e. the grinding disc having alternating wide blades and narrow blades, with spaced apart straight open slots and spaced apart arcuate open slots, each straight open slot between a short fin of a narrow blade and a long fin of a wide blade and each arcuate open slot between a short fin of a wide blade and a long fin of a narrow blade;

f. as the disc is rotating, airflow starts at the central hub and extends over transverse lip and due to the orientation of the long fins and narrow fins adjacent respective straight open slots and arcuate open slots, the air is forced into the straight open slots and arcuate open slots so that cooling air is transmitted to a workpiece adjacent the underside of the disc.

6. The grinding or polishing disc in accordance with claim 5 wherein the peripheral edge of the disc has a predetermined axial extent so that there is sufficient structural integrity of the disc at the peripheral edge to withstand the forces involved in the grinding or polishing operation.

* * * * *